United States Patent [19]

Stahli

[11] 3,991,616

[45] Nov. 16, 1976

[54] AUTOMATIC PIPETTER

[75] Inventor: Christian Stahli, Evanston, Ill.

[73] Assignee: Hans Noll, Evanston, Ill. ; a part interest

[22] Filed: Sept. 8, 1975

[21] Appl. No.: 610,997

[52] U.S. Cl. ..... 73/421 R; 23/259; 73/425.6; 222/136

[51] Int. Cl.[2] ..... B01L 3/02

[58] Field of Search ..... 73/421 R, 421 B, 423 A, 73/425.6; 222/136, 137, 145; 23/292, 259; 141/237, 244

[56] References Cited

UNITED STATES PATENTS

| | | | |
|---|---|---|---|
| 3,184,122 | 5/1965 | Nerenberg | 222/255 |
| 3,607,082 | 9/1971 | Thiers | 23/292 |
| 3,612,360 | 10/1971 | Ambrose | 222/340 |
| 3,719,087 | 3/1973 | Thiers | 73/425.6 |
| 3,771,490 | 11/1973 | Kinney | 222/136 |
| 3,831,618 | 8/1974 | Liston | 137/154 |
| 3,915,651 | 10/1975 | Nishi | 73/425.6 |

OTHER PUBLICATIONS

Pressure Lok Catalogue — Precision Sampling Corp. — 1971 — P O Box 15,119, Baton Rouge, La. 70815.

Hamilton–H–70R Catalogue—Hamilton Co.—1969—P.O. Box 307–Whittier, Calif. 90698.

*Primary Examiner*—S. Clement Swisher

*Attorney, Agent, or Firm*—Eugene F. Friedman

[57] ABSTRACT

An automatic pipetter utilizing a syringe having several openings at its end. A different tubing segment connects with each of these openings and extends into different vials of liquids. Of these vials, one contains a buffer solution generally used in appreciably greater quantities than the others. Another vial receives the liquids from the syringe. As a stepping motor partially withdraws the piston from the syringe, a tube leading to a vial with unmeasured liquid is open. When the stepping motor reinserts the plunger into to the syringe, the tube leading to the receiving vial becomes open while the other tubes remain closed. The tubing segments extending between the syringe and the vials include three sections. The section closest to the syringe, formed from polyimide, undergoes a minimal change in its volume notwithstanding the negative and positive partial pressures exerted by the piston. The second section, having a plasticized polyvinyl chloride construction, has greater flexibility than the polyimide portion. Pinching off this flexible section from the outside provides a valving device for the system. The last section of the tubing consists of stainless steel and runs into the vial to provide a high degree of rigidity. Coating the inside with dimethyldichlorosilane reduces its rusting and crosscontamination between pipetted liquid. In operating the pipetter, the buffer should follow the other liquids placed into a single container. This washes the syringe between samples and avoids carry-over error from one sample to the next. After expelling fluid from the syringe, the stepping motor moves at least one step in the direction of withdrawing the piston but with the outlet open. This removes the slack in the coupling between the motor and the piston and increases the accuracy in the volume of sample drawn into the syringe. The pipetter, when called upon to deliver a microliter of a particular liquid, will deliver from .98 to 1.02 microliters at least 90 per cent of the time.

50 Claims, 11 Drawing Figures

Fig 1
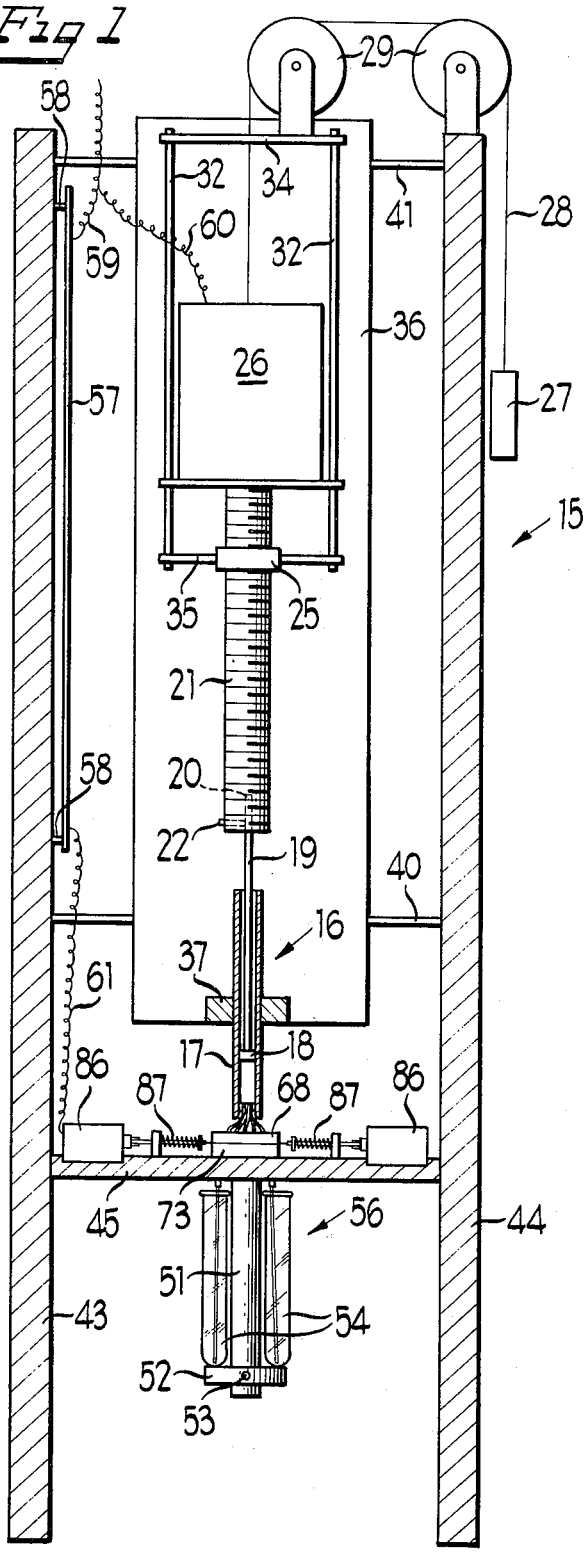
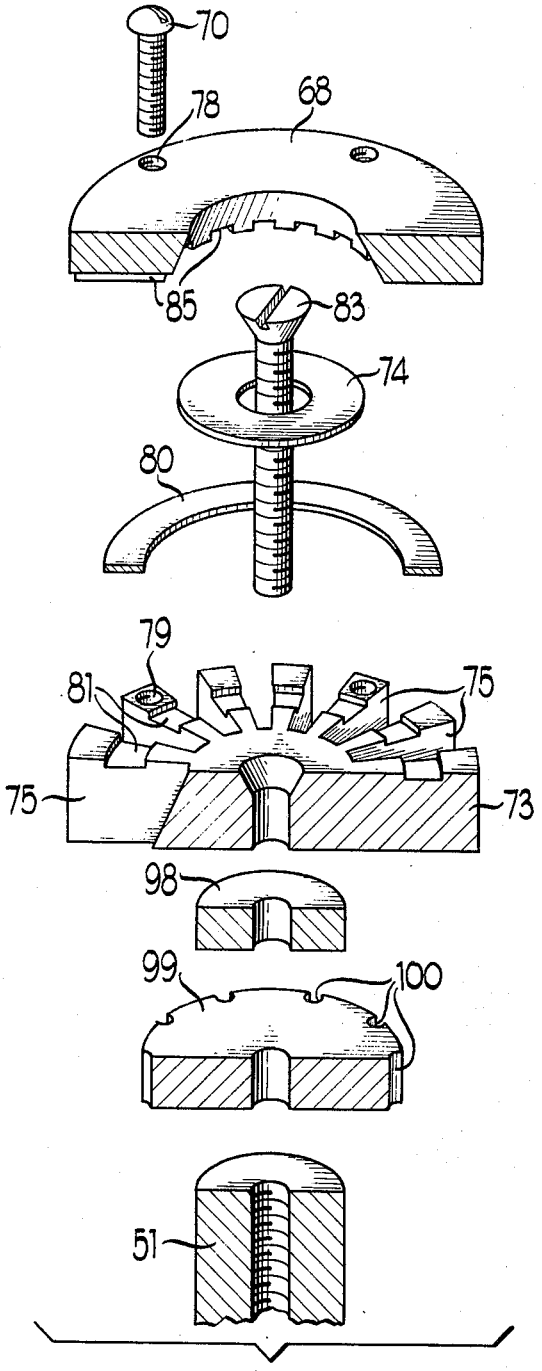
Fig 7

Fig 2
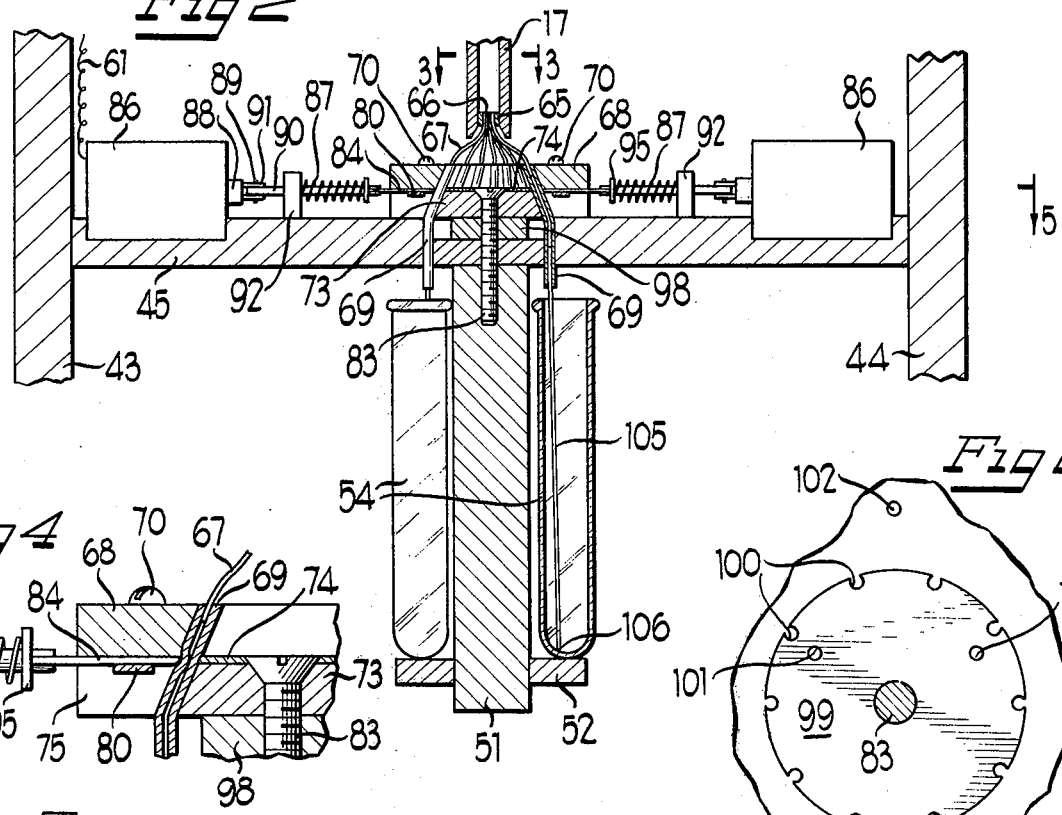
Fig 4
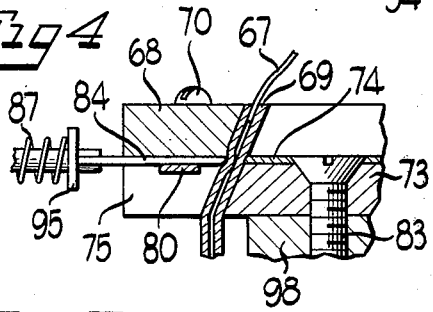
Fig 6
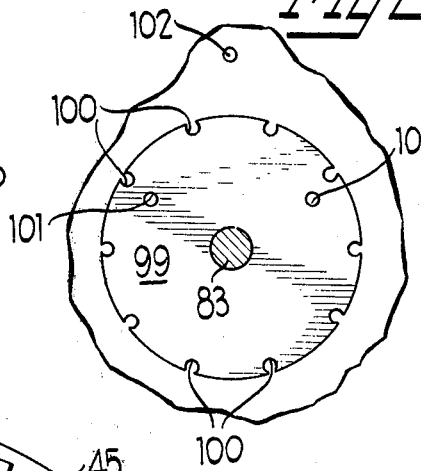
Fig 3
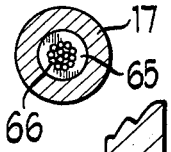
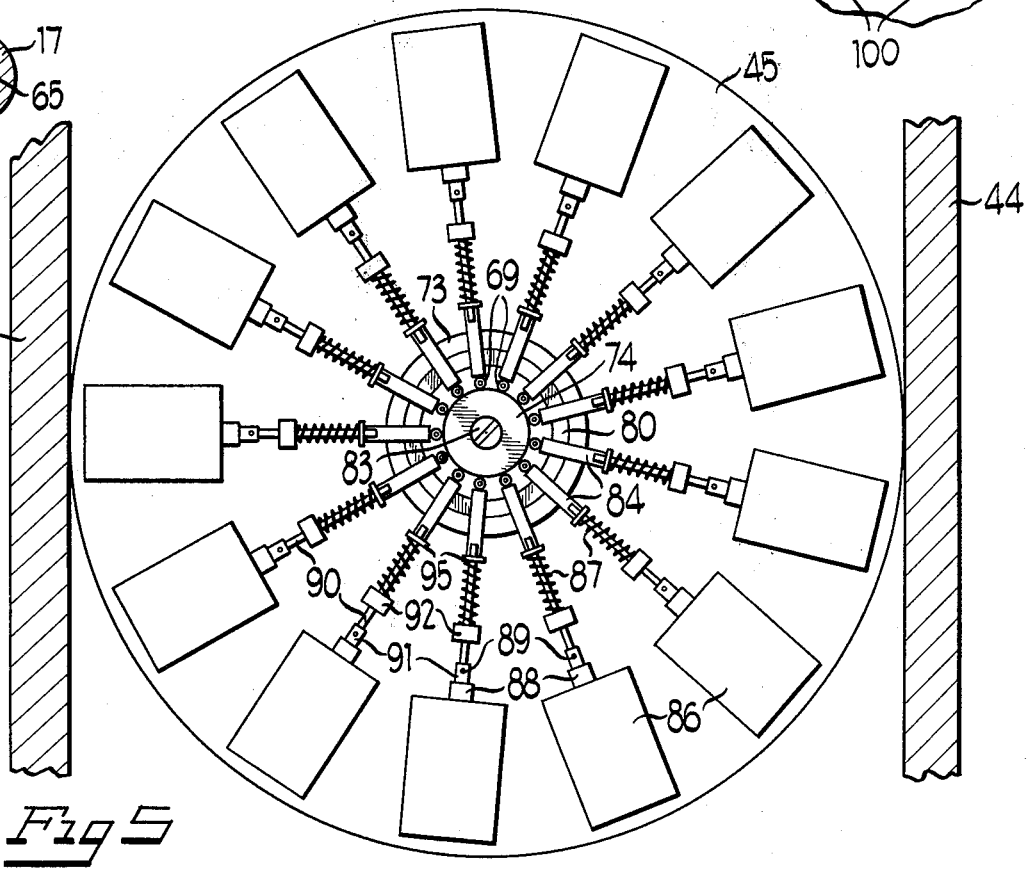
Fig 5

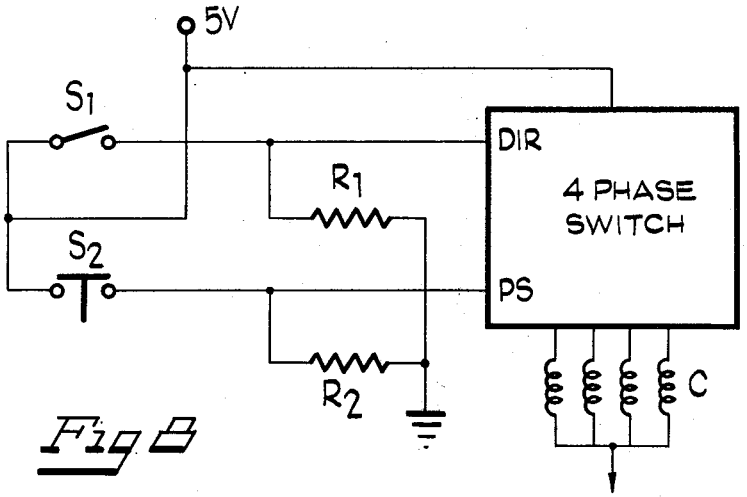
Fig 8
Fig 10
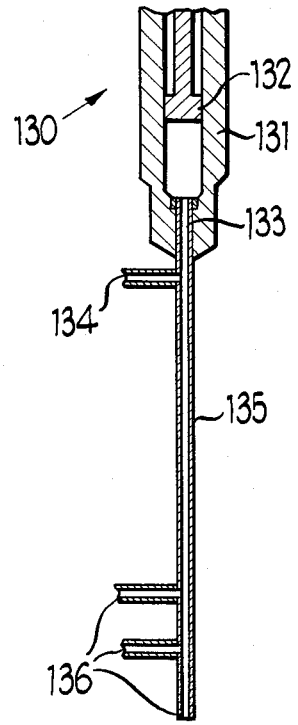
Fig 9
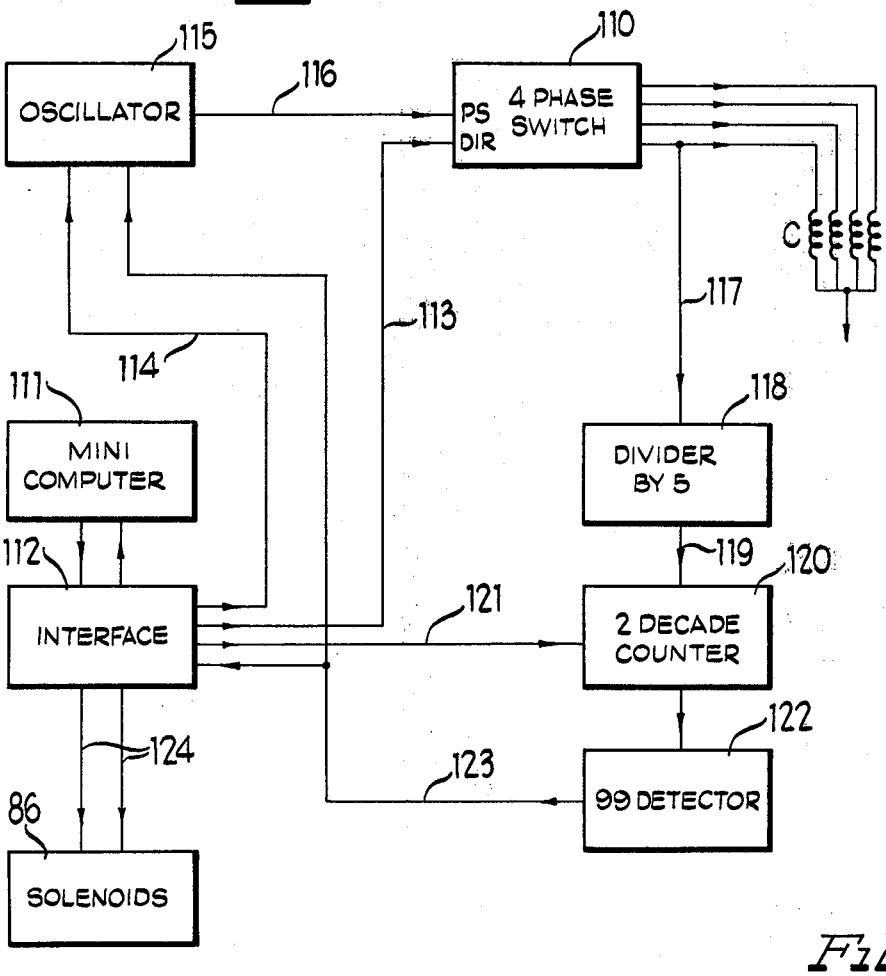
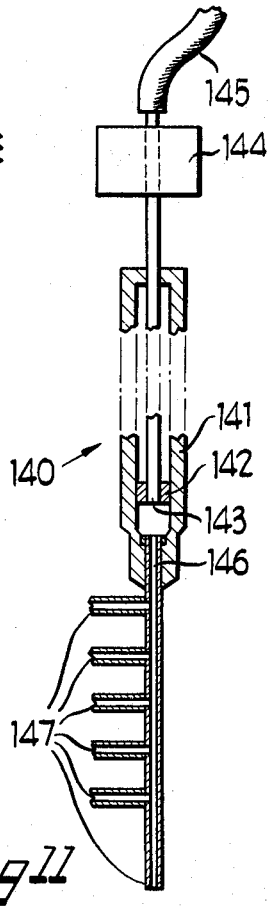
Fig 11

AUTOMATIC PIPETTER

BACKGROUND

The measuring of small quantities of fluid has become increasingly important with the development of the microbiological sciences. This stems first from the fact that even small quantities of biological liquids display a high degree of activity. Furthermore, the reseacher and manufacturer frequently have only such miniscular volumes with which to work. In addition, the use of small concentrated samples allows faster reaction rates with the concommitant efficiency in the laboratory.

Consequently, pipetters designed to handle these exceedingly small volumes must do so with a great degree of accuracy. Further, in their design, they should not require a large volume to "prime" them before delivering a small quantity. Moreover, because of the large number of samples occasionally required for different research programs, the design of the pipetter should submit to automation.

Also, the pipetter should not possess pockets or sacks which can trap appreciable quantities of the sample fluid. The secreted fluid, possibly released at subsequent times, can result in deleterious contamination of the samples produced.

Various devices have attempted to satisfy the needs of microbiological measurements. Some of those with greater recency have performed adequately well as parts of particular types of apparatus for which designed.

The capillary tube has represented the classical method for transferring small measured quantities of liquid. Dunking one end of the thin glass tubes allows them to fill through capillary action. Appying to positive gas pressure to the other end will then expel the liquid from the tube into the desired receptacle.

While providing generally acceptable accuracy and precision, the capillary-tube technique suffers from apparent drawbacks. The first, of course, concerns the fact that each measurement requires the handling and control of the device by laboratory personnel; it possesses none of the advantages normally associated with mechanization and automation.

Moreover, while most liquids will rise in the tube under the force of capillary action, the large viscosity of some may prevent them from doing so. Accordingly, the utility of the tubes may not extend to all liquids.

A hand-held and actuated pipetter with disposable fluid-containing tips has provided some assistance in the measuring of small quantities of liquid. Actuating a button with his thumb, the laboratory attendant draws into the tip a predetermined quantity of fuild. Actuating the button a second time releases the fluid from the tip. Again, though, the device requires constant personal attention and does not readily admit of automation.

Sophisticated syringes have also found use in delivering small quantities of fluid. To increase its accuracy, one syringe has had a micrometer screw attached to its piston while providing a digital readout to control its operations. However, purging the system of air represents a significant problem with syringes. The usual technique of pointing a syringe upward to remove the final air bubble provides a serious inconvenience where the device finds use in automated apparatus.

Moreover, the syringe must generally be moved from one or more vials containing the source liquid to a sample tube where it expels the fluid. This movement further limits the utility of the syringe for automated systems. Additionally, dipping the syringe into various solutions allows the deposition of various substances on the outside of its needle. There, it may result in contamination of subsequent fluids with which it makes contact.

In an attempt to ameliorate some of these problems, one company has introduced a syringe in which the piston or plunger extends all the way through both the barrel of the syringe and the needle attached to it. At the base of the needle, where it joins the glass cylinder, the syringe also includes a side opening to the needle shaft. Withdrawing the plunger to its fully retracted position allows the filling of the needle shaft through this side vent. Depressing the plunger various amounts then expels measured quantities of fluid from the tip of the needle.

In order to fill the needle through the side vent, however, requires the plunger to recede to its most retracted position. Consequently, the sample fluid must fill the entire needle. This may require more sample fluid than available at that time. Moreover, where the desired samples do not require the total volume contained in the needle, waste of possibly precious fluid results.

A separate commercial syringe incorporates a hollow plunger within the glass body. This allows the filling of the cylinder through the plunger itself. Again, however, the syringe requires sufficient sample volume to fill the plunger. Not all situations may provide this amount of sample liquid. Moreover, as with the above model, this may result is a substantial waste of precious fluid.

S. T. Nerenberg, in his U.S. Pat. No. 3,184,122, shows a pipette with a two-way glass stopcock and a barrel having a side inlet. Turning the stopcock to a first position fills the tip of the pipette up to the stopcock with a sample fluid. Simultaneously, the barrel of the pipette fills with a second or diluent fluid. With the stopcock in a second position, the sample fluid in the tip exists the pipette into a receptacle followed by a desired amount of the diluent.

To fill the tip of the pipette, however, requires its insertion into the desired fluid with the accompanying possibilities of contamination. Moreover, the tip can not accomodate varying amounts of sample, but only a single preset quantity. Moreover, the apparatus may produce an appreciable waste of the sample fluid during the filling process.

Moreover, the involved liquids contact and, thus, can contaminate the stopcock itself. Also, the amount of liquid entering the areas involved with this internal valving could produce erroneous results for small measured volumes of fluid. Additionally, the tip must move from the sample fluid to the output receptacle during the measuring process. This transition becomes difficult for automated systems to accomodate.

U.S. Pat. No. 3,831,618 to M. D. Liston shows an apparatus processing a capillary probe that forks into two separate capillary conduits. The first line connects to a syringe and contains a silicone oil. The second conduit, filled with a diluent, also connects to a syringe. Withdrawing the silicone oil further into the recesses of the first line allows the ingestion of a sample liquid through the probe. Subsequent shifting of the various liquids will then leave a desired amount of the sample in the common area connecting to both lines. The syringe with the diluent may then expel this fluid into the sample receptacle.

Each of Liston's syringes have pistons under the control of a digital stepping motor. The motor in turn couple through electronic controls to a programable device which directs the behavior of the apparatus.

Liston's device, however, dips its probe into the sample fluid undergoing analysis. This allows the possibility of contaminated or inaccurate samples as discussed with the other systems above. Moreover, Liston does not consider the measuring of different sample liquids while avoiding cross-contamination between them in the first capillary tubing.

W. J. Ambrose et al., in their U.S. Pat. No. 3,612,360, disclose a fluid-handling apparatus with improved valves and piston. The system based on these components automatically transfers quantities of a sample as well as additional liquids into a receptacle. While incorporating significant improvements, the device utilizes a single probe to both ingest and expel fluids. This, of course, will impose the limitations discussed above for pipetters in which the fluids pass both into and out of the system through a common opening. Ambrose et al. also reveal new valves which have worked well with their desired quantities of fluid. Their stated error of not more than one microliter could becomee unacceptable for systems delivering microliter quantities of fluids.

R. E. Thiers incorporates a different type of valving in his U.S. Pat. No. 3,719,087. There, he pinches flexible hosing to control the air and vacuum pressure drawing a fluid into and expelling it from a pipette. However, he has not included it in an automated device using a syringe as the basic measuring component.

Many of the devices described above have advanced and improved the techniques of measuring small quantities of fluid. However, the search continues for apparatus which will accurately perform this function in the microliter range, admit to facile automation, and avoid contamination.

SUMMARY

A pipetter generally includes a container for holding the fluid undergoing measurement. Moreover, it also possesses a measuring device in fluid communication with the container. To achieve versatility, this measuring device should have the ability of placing different predetermined amounts of fluid into the container. Naturally, the pipetter also allows the fluid within to move outside and into the receiving vial.

The containing means should have at least two openings in it, permitting the passage of fluid to enter the container through one opening and depart through another. This unidirectional flow of fluid obviates the dipping of a needle or probe into a source of fluid; moving that needle to a different position; and expelling the fluid through that same needle with the possible resulting contamination.

The opening should allow the passage of fluid into the container without necessarily first contacting the measuring means. This avoids having extensive amounts of precious fluid occupied with priming the connections associated with the measuring means.

Having fluid inside, the container and measuring means should permit it to depart through an opening other than that though which it entered. This establishes the unidirectional flow mentioned above. Moreover, to minimize error, the measuring device and the container should allow a measured fluid to depart without substantial dilution by any other substance. Requiring appreciable dilution by another fluid may introduce unacceptably large amounts of that other fluid as well as precluding the complete elimination of the measured ingredient from the container.

Generally, the measuring device and container take the form of a syringe and plunger. Specifically, the syringe has the form of a cylinder with a plunger acting as piston inside. The requisite openings appear at the end of the cylinder through which the piston rod does not pass.

Alternately, the containing means may include at least three or more openings permitting the passage of fluid through them. This represents a convenient arrangement permitting the pipetting of different fluids into a common receptacle without either changing pipetters or dipping a probe into different fluids. Nonetheless, the fluid placed inside the container through at least one of the openings should depart the container through another opening without substantial dilution by some other fluid.

The operation of a pipetter with several openings generally includes placing a particular fluid through a first passageway into the container. Closing this first passageway then prevents the return of the measured fluid back to its source. The subsequent opening of a second passageway permits the pipetter to deliver the measured fluid into the desired receptacle vial. With the second passage open, substantially all of the particular fluid moves out of the container without substantial dilution. The pipetter may operate further by opening a third passageway and moving a fluid through it.

As a separate aspect, a pipetter will possess, in addition to a container with at least one opening and a measuring means, a segment of tubing to direct and control the flow of fluid. To perform this function, the tubing segment connects to and has fluid communication with the pipetter's opening and containing means. Fluid passing through the opening also passes through the tubing.

However, composing the tubing segment of at least two different sections allows the advantages of external valving with a minimal effect upon the accuracy of the measurements. One section displays sufficient flexibility to permit a valving means to operate upon it from the outside. The valving device, in turn, should exert a sufficient pinching force upon this section of tubing to constrict it and substantially prevent the passage of fluid. The external valving precludes errors resulting from internal parts with their possibly leaking closures and dead volumes that could contain undesired amounts of fluid.

The other section of the tubing segment generally runs from the container to that section on which the valving mechanism operates. The pressures created by the piston as it moves the fluid into or out of the container extend down to the location of the tubing where the valving operates. These pressures could induce a change in the volume of the tubing segment itself, especially if the entire segment possessed sufficient flexibility to allow pinching by the valving mechanism.

Including a rigid section of tubing between the container and the valving area minimizes any change in the capacity of the tubing segment due to the partial pressures moving the fluid in and out. In particular it should possess sufficient rigidity to avoid a substantial change in its internal volume when fluid enters or leaves the container as compared to when the fluid remains at rest. Thus, one section of the tubing segment maintains its volume capacity substantially constant during the operation of the pipetter; the other section permits the valving action upon the outside of the tubing.

BRIEF DESCRIPTION OF THE FIGURES

FIG. 1 give a general elevational view of an automatic pipetter producing accurate fluid measurements in the microliter range.

FIG. 2 has an enlarged view of the area in FIG. 1 containing the bottom of the syringe, the tubing segments connecting to the syringe, the valving arrangement, and the source and receptacle vials.

FIG. 3 has a cross-sectional view along the line 3—3 in FIG. 2 illustrating the multitude of openings at the end of the syringe used in the pipetter.

FIG. 4 give an enlarged view of FIG. 2 in the area of a single tubing segment with its associated valving mechanism.

FIG. 5 has a cross-sectional view along the line 5—5 of FIG. 2 and concentrates upon the valving section of the pipetter.

FIG. 6 displays a cross-sectional view along the line 6—6 and shows the spatial arrangement of the openings in the supporting plastic block through which the tubing segments pass.

FIG. 7 has an exploded view of the components associated with the passage of the tubing segments from the syringe to the various vials.

FIG. 8 gives a simple circuit for the manual control of the stepping motor used in FIG. 1.

FIG. 9 portrays a block diagram of components for the automated control of the pipetter in FIG. 1.

FIG. 10 shows an alternate syringe that may find use in an automatic pipetter and in which all of the liquids enter through the needle associated with the syringe.

FIG. 11 shows an additional syringe in which one measured fluid enters through the plunger of the syringe while the others enter through the associated needle.

DETAILED DESCRIPTION

The automatic pipetter, shown generally at 15 in FIG. 1, includes centrally the syringe 16 composed of the cylindrically shaped container 17 and a piston 18 motivated by the rod 19. The supplier of the syringe 16 has removed a rounded tip from the end of the teflon piston 18 and filled in the hole that results, to give it a flat configuration. Otherwise, the Hamilton Company supplies the syringe 16 under the model number 1710.

The rod 19 terminates in the hole 20 in the end of the precision screw 21, as shown in phantom. The Allen screw 22 enters the side of the precision screw 21 until it lodges against the rod 19 to retain it in place.

The precision screw 21 passes through the precision nut 25, in which it has freedom of rotational motion, and connects to the stepping motor 26. The motor 26 rotates the screw 21 to produce a relative translational motion between the screw 21 and the nut 25. The screw 21, translating within the nut 26, takes with it the rod 19 to produce a relative translation between the piston 18 and the cylinder 17. Rotating the motor 26 in one direction pulls the piston 18 upwards tending to withdraw it from the syringe 16. As usual, this motion draws fluid into the container 17. When the motor 26 rotates the screw 21 in the opposite direction, the screw 21 inserts the piston 18 further into the syringe 16 to expel fluid from the container 17.

Because of their tight connection, the rotation of the screw 21 results in a similar rotation of the shaft 19 and, thus, the piston 18. This rotational movement of the piston 18 would not appear to induce any deleterious results. However, if desired, a pivotal connection between the shaft 19 and the screw 21 would allow for its elimination. Conveniently, this could take the form of broadened shoulders on the ends of the shafts riding on ball bearings within a coupling. This coupling would allow a relatively free rotation but minimal translation between the two members.

As the screw 21 travels up and down, so does the motor 26. The motor 26, in turn, receives guidance from the vertical rods 32 which slide along linear bearings provided in openings in the motor's base plate 28. The motor 26 may lack sufficient torque to lift its own weight. Consequently, the counterweight 27 relieves it from this burden. The counterweight 27 connects to the motor 26 through the string 28 which passes over the pulleys 29.

The guide rods 32 rigidly attach to the upper plate 34 and the bottom plate 35, with the latter also connecting to the nut 25. The upper and lower plates, 34 and 35 respectively, attach to the metal backing plate 36. The extension 37 also connects to the plate 36, projecting forward from it. The extension 37 surrounds the syringe 16 and holds it tightly in place.

Consequently, the syringe 16, through the extension 37, the backing plate 36, and the bottom plate 35, has a fixed spatial relationship to the nut 25 and, in the absence of any rotation, to the screw 21. When the precision screw 21 rotates within the precision nut 25, these connections effectuate a precision alteration between the cylinder 17 and the screw 21. This produces a precise amount of movement of the piston 18 within the cylinder 17 to draw in a precise amount of fluid. From there, it may subsequently depart into the desired receptacle.

The back-plate 36, in turn, displays a rigid affixation to the upper cross bar 41 and the lower cross bar 42, both of which connect to the side plates 43 and 44. The lower plate 45 also connects to the plates 43 and 44, which, with the cross bars 41 and 42, may have a construction of a plastic such as Plexiglas of Lucite.

The tube holder, generally at 50, sits below the lower plate 45. Its parts include the rod 51 and the platform 52 which may slide along the rod 51. The screw 53 retains the platform 52 at the desired height on the rod 51. The tubes 54 for various liquids sit upon the platform 52.

The electrical wiring board 57 sits alongside the side plate 43, where the spacers 58 hold it at a slight distance. The electrical lead 59 from the board 57 joins the lead 60 from the motor 26 to connect with the external control circuitry. The lead 61 connects the board 57 to the varying control mechanism which sits on the lower plate 45.

FIG. 2 shows the valving mechanism in greater detail. As shown, the cylinder 17 has, at its lower end, a teflon ring 65 with thirteen tubules 66 passing through and glued to it, with the glue filling the spaces between the tubules. FIG. 3 looks down from the top upon the end of the cylinder 17. As shown, the cylinder wall 17 surrounds the plug 65 having openings formed by the tubing segments 66 passing through it. Stated alternatively, the cylinder 17 has a plug formed of a fluid-impermeable material with the ends of the several tubing segments 66 embedded in it.

The tubing segment 66, as it departs the cylinder 17, includes first a relatively thin section 67. This first section 67 traverses the distance from the cylinder until it approximately reaches a plastic disk 68. There, it becomes embedded and glued in the thicker tubing section 69 which passes along the inside of the plastic disk 68. The cylinder 17 and the tubule 66 possess a generally vertical orientation to minimize the length of the first and second tubing section 67 and 69, respectively.

As seen more clearly in FIG. 4, the screws 70 hold the plastic disk 68 to the slotted plastic disk 73. The thickened tubing section 69 descends along the outside of the metal ring 74 and lies in place in one of the slots in the slotted disk 73.

FIG. 7 shows the construction of these various pieces with greater detail in an exploded view. In it, the plastic disk 68 appears as an angular ring with a large opening in its middle through which the tubing sections 67 pass.

The screw 70 passes through the opening 78 in the plastic ring 68 and into the opening 79 to hold the ring 68 to the slotted disk 73. As a result, the large metal ring 80 is sandwiched between them and sits in the groove 81 in the disk 73. Moreover, the flat head screw 83, inter alia, holds the metal ring 74 to the slotted disk 73.

FIG. 4 shows the wide metal ring 80 located between the plastic ring 68 and the slotted disk 73. The thin metal blades 84 rest upon this ring 80 and may slide back and forth upon it. To accomodate the blade 84 and to allow additional room for its sliding motion, the plastic ring 68 has grooves 85 on its underside. Once again, FIG. 7 shows these grooves 85 in greater detail.

When the blade 84 slides sufficiently toward the metal ring 74, it pinches the tubing section 69 until it closes, to prevent the passage of fluid through it. Sliding away from the metal ring 74, it opens the tubing section 69 and fluid may then pass into or out of the cylinder 17. Rounding the edges of the blade 84 and the ring 74 minimizes the damage to the tubing produced by them.

The operation of the valving blade 84 proceeds under the influence of both the solenoids 86 and the springs 87. When energized, the solenoid 86 pulls its plunger 88 away from the metal ring 74. The screw 89, in turn, connects the rod 90 to the end 91 of the plunger 88. These rods 90 pass through openings in the plastic post 92, which connect to the bottom plate 45, and attach to the valving blades 84.

Consequently, the plunger 88 moving away from the metal ring 74, takes with it the rod 90 and the valving blade 84 glued to it. This action proceeds against the extension force of the spring 87 and opens the tubing section 69.

Upon the relaxation of the solenoid 86, the spring 87, pushing against the post 92, forces the washer 95 toward the metal ring 74. The washer 95 then pushes the metal blade 84 in the same direction to squeeze the tubing section 69 and close it off to the flow of fluid.

Thus, in its normal configuration, with the solenoid 86 unenergized, the spring 87 forces the blade 84 against the tubing segment 69 to keep it closed. The tube will open only when the actual energization of the solenoid 86 retracts its plunger 88 away from the metal ring 74.

As FIG. 5 shows, each of the thirteen tubing sections 69 has its own solenoid 86 along with the rest of the associated valving mechanism. Placing them in a circle represents a convenient arrangement for them.

Returning to FIG. 2, the slotted disk 73 rests upon the bottom plate 45. Underneath sits the small plastic spacer 98 where the screw 83 keeps it properly positioned. Below the spacer 98 comes the grooved disk 99 followed by the sample-holding rod 51. FIG. 7 gives greater details of these components in an exploded view while FIG. 6 has a bottom view of the grooved disk 99.

In FIG. 6 and 7, the grooved disk 99 has ten circular grooves 100 equally spaced around its perimeter. Each groove 100 wedges the tubing section which passes through it against the bottom plate 45. Additionally, two tubing sections 69 pass directly through the interior holes 101 in the disk 99. These relatively inaccessible tubing sections may, for example, connect to receptacle vials in the stem 51, one of which collects waste fluids, while the other contains a rinse liquid. A further tubing section 69 may pass through the opening 102 in the bottom plate 45 rather than the grooved disk 99. This may then enter a vessle for the collection of a prepared sample.

Returning to FIG. 2, the tubing section 69 terminates just below the bottom plate 45. A rigid section of tubing 105 then begins inside of the tubing section 69 and continues down into the sample vial 54. The tubing section 105 has a sufficient insertion inside of the plastic section 69 that a portion of its length wedges between the grooved disk 99 and the bottom plate 45. With a construction of metal, for example, this wedging causes the rigid section 105 to point directly toward the bottom of the vial 54. With sufficient length, the end of the metal section 105 will remain at the bottom 106 of the vial 54. In this location, the tubing 105 can reach substantially all of the precious fluid in the sample vial 54, providing a conduit for it to reach the cylinder 17.

As described above, each tubing segment 66 possesses the three sections, 67, 69, and 105. The first section 67 has a relatively small outer diameter and must undergo the bends and curves shown in FIG. 2. It must also possess sufficient rigidity that its internal volume experiences substantially no change when the piston exerts its positive or negative partial pressures when altering the fluid content of the syring 16.

The second section 69, as shown, has a relatively thick outer diameter. Its greater flexibility allows the valving blade 84, pushing in the direction of the metal ring 74, to squeeze off its interior and prevent the passage of fluid through it.

Thus, the two sections 67 and 69, in effect, accomplish contradictory objectives. The latter displays the flexibility to allow valving from its exterior; the former possesses the needed rigidity to avoid appreciable change in its volume notwithstanding the partial pressures it will experience. This combination achieves external valving and eliminates the internal parts which can contribute to erroneous results. Yet, it undergoes sufficiently minimal volume changes to avoid introducing inaccuracies into the measured quantities.

The large outer diameter of the tubing section 69 assists in opening its passageway when the valving blade 84 moves away from the metal ring 74. However, to assist in closing off this section 69, it may have a reduced outer diameter which will present less resistance to the pinching force exerted by the blade 84 and the ring 74. This reduction does not hinder the restoring force of the normally large outer diameter of the section 69 since is occurs only in the immediate region of the valving members and not in the area beyond.

The last tubing section 105 displays a rigidity derived from a construction of metal. Since the metal section 105 possesses none of the usual flexibility of the first tubing section 67 or the thickened section 69, it accordingly reaches down into the bottom of the vials 54.

As a specific example, the first section 67 may have a construction of polyimide with an inner diameter of 0.008 inch and a wall thickness of about 0.0010 to 0.0015 inch. The polyimide material displays a slight tendency to adsorb some materials, with their possible release and contamination of subsequently prepared solutions. Coating the polyimide with dimethyldichlorosilane has reduced this sorption by the tubing.

Other materials may also suffice for the first tubing section 67. Tetrafluoroethylene polymers (sold as Teflon by E. I. du Pont de Nemours & Co.) in appropriately sized tubing may provide one alternative. Another may take the form of steel of platinum tubes. A metallic construction, however, presents the possibility of corrosion and of releasing heavy metal ions into the prepared solutions. However, its performance may suffice in particular situations.

The thicker middle tubing section 69 has a composition of plasticized polyvinylchloride such as Tygon tubing sold by The Norton Company. An inner diameter of approximately 0.0075 inch allows a good press-fit of the slightly larger polyimide section 67. A general outer diameter of 10 to 20 times the inner diameter achieves the resiliency to open itself, mentioned above.

The metal section 105 has a composition of stainless steel, although other materials may suffice. Press-fitting the metal section 105 into the middle section 69 allows facile replacement of the former should it develop appreciable corrosion. A coating of dimethyldichlorosilane will reduct its propensity to dispense undesired heavy-metal ions as well as absorbing and later emitting components of various sample fluids.

The simple circuit diagram in FIG. 8 may find use in controlling the stepper motor 26 in FIG. 1. The coils C of the motor connect to the switch 110. A four-phase stepping motor with its four coils requires a four-phase switch 110. In the particular case of a Phillips ID05 four-phase motor, the four-phase switch 9904 131 03003 by S.A. Polymotor provides adequate control.

In addition to a five-volt supply input, the switch 110 has the directional input DIR to control the direction of rotation produced by the motor 26. The stepping pulse input PS induces the desired steps of rotation.

With the single-pole single-throw switch $S_1$ open, the directional input DLR connects to ground through the resistor $R_1$ (which, like $R_2$, may have a value of 4700 ohms). Accordingly, zero volts appear at the DIR input and produces a first direction of motion. Closing the switch $S_1$ connects the DIR input directly to the five-volt source and thus results in the opposite direction of rotation from the stepping motor.

The spring-loaded switch $S_2$ normally remains open. In this configuration, the stepping pulse input PS to the switch 110 connects through the resistor $R_2$ to ground. Accordingly, it experiences a zero-volt input. This zero volts does not effectuate any rotation of the motor. Closing the switch $S_2$ briefly connects the PS input to the five-volt supply potential to provide a short positive pulse. This pulse produces one step of rotation of the motor.

The circuit in FIG. 8 requires separate manual controls in the form of the switches $S_1$ and $S_2$ both to control the direction and to induce rotation of the stepper motor. Furthermore, the solenoids 86 in the figures would also require separate and coordinate control to open the right tubing segments 66 during the operation of the motor 26.

The diagram in FIG. 9, however, not only coordinates the control of the solenoid 86 with the motor, but can also automate the operation of the pipetter to prepare a complex sample. In pursuing these ends, the minicomputer 111 imparts its flexibility to the circuit and to the rest of the apparatus.

The computer 111 speaks to the remainder of the circuit through the interface 112. This item, of course, converts the computer output into signals usuable by the other components. As one example of this control, the interface 112 connects along the lead 113 to the directional DIR input to the switch 110. This provides the proper voltage to rotate the motor in the desired direction.

The interface 112 also connects along the lead 114 to the oscillator 115, which may take the form of a bistable multivibrator. Upon command from the computer 111, the interface 112 signals the oscillator 115 to produce positive pulses. These pulses travel along the lead 116 to the stepper-pulse input PS of the switch 110. Each pulse on the lead 116 causes the switch 110 to energize the motor's coils C to produce a single step of rotation.

The remainder of the circuit serves to turn the oscillator 115 off. Specifically, each of the coils C becomes energized once for each four steps of rotation of the motor. Accordingly, one positive pulse appears along the lead 117 to the divider 118 for each four steps of rotation. The divider 118, in turn, produces one pulse on its output lead 119 for each five input pulses from the lead 117. Consequently, a pulse appears along the lead 119 for each twenty steps of rotation produced by the motor. However, for 20 steps of rotation, the apparatus moves 1 microliter of fluid. Consequently, each positive pulse along the lead 119 corresponds to the movement of 1 microliter.

The two-decade counter 120 counts the pulses corresponding to the microliters from the lead 119. However, prior to the operation of the motor, the interface, acting along the lead 121, places the 99 complement of the number of desired microliters into the counter 120. This, when added to the selected number of microliters, will total 99. Consequently, when the counter 120 reaches the number 99, the pipetter has moved the desired quantity of fluid.

The detector 122, connected to the counter 120, provides an output along the lead 123 when the counter 120, in fact, reaches 99. This signal on the lead 123 stops the pulses along the lead 116 from the oscillator 115 to the switch 110. Furthermore, it also informs the interface 112 of the moving of the predetermined quantity of fluid so that the apparatus may move on to its next operation.

The interface 112, for further convenience and automation, has the connections 124 to the solenoids 86. This permits the atutomated operation of the solenoids at the proper time to move the desired fluids through the correct tubing segments.

A priming of the pipetter should precede the actual preparation of a solution. A thorough priming involves a number of different steps. All of these may proceed from a program placed on the computer 111.

In this regard, 13 tubing segments 66 extend between the syringe 16 and the various test tubes 54 as shown in FIGS. 2 and 5. Not all of the vials 54 may actually contain any liquid; the solutions under construction may only have a few components and, thus, not need the total capabilities of the pipetter. However, some of the tubing segments 66 do lead vials 54 that, in fact, contain components of the solution undergoing formulation. These segments should have liquid from the vials brought up through them until it reaches the syringe 16. Accomplishing this merely requires energizing each appropriate solenoid 86, in turn, to open the correct tube and withdrawing the plunger 18 far enough to fill the tubing segment with liquid. Opening the outlet tubing and reinserting the plunger will remove air in the syringe 16 prior to the operation; the air brought into the syringe 16 through the tubing segment 66; and any excess liquid entering the syringe 16 from the tubing segment. Each tubing segment 66 leading to a vial 54 with a desired liquid will undergo this procedure.

Each tubing segment 66 not leading to a liquid constituting part of the desired solution must, nonetheless, contain liquid between the valving blade 84 and the syringe 16. Otherwise, a gas contained in this region can undergo appreciable volume change under the partial pressures produced by the motion of the plunger 18. These volume changes will introduce errors into the actual measured quantities.

Conveniently, the buffer or any non-active liquid required in the prepared solution in large amounts may fill this portion of an otherwise unused tubing segment 66. To accomplish this, the valving blade 84 for the vial 54 with the buffer, for example, should open; the plunger 18 withdrawn to draw sufficient buffer into the container 17; the tubing 66 leading to the buffer closed; the unused tubing opened; and the plunger 18 reinserted sufficiently to fill the needed portion of the tubing segment with the buffer.

Lastly, the tubing segment leading to the receptacle vial should also contain liquid. Specifically, it should contain the buffer or neutral liquid as appropriate. To do so, the syringe should pull in buffer; the buffer tubing closed; the outlet tubing opened; and the buffer pushed out until it completely fills the entire outlet tubing segment.

Preferably, the piston 18 should draw in a large excess of buffer when priming the outlet tubing. By passing all of this through the outlet, it will wash the syringe 17 and remove the air bubbles that generally find their way into it. Have thus undergone this priming procedure, the pipetter may now begin the preparation of an actual solution.

However, an additional procedure at this point will help remove slack in the system and provide for more accurate measurements. This step should occur prior to opening a tubing segment leading to a sample vial 54 with a liquid forming part of the desired solution. With the outlet tubing open, the stepping motor 26 should rotate at least one step in the direction to withdraw the piston 18 from the cylinder 17. This will remove the slack in the coupling between the motor 26 and the piston before placing any liquids into the syringe.

As the motor steps backwards, the liquid in the open outlet tube moves towards the syringe. Consequently, to properly remove any subsequently injested liquid from the syringe, the piston 18 should reassume the position it occupied prior to this single step. Alternatively, prior to the single step backwards, the motor may first take a single step forward with the outlet tube open, followed by the backward stepping. This removes the slack and eliminates the need for a subsequent correcting step. This technique involving additional steps of rotation, as well as the priming routine, readily submits to automation through the proper programing of the computer 111 in FIG. 9.

The pipetter may now proceed to construct the desired solutions. After the step down and backward, the outlet tubing closes. A tubing segment leading to one of the source liquids then opens. The stepping motor rotates the number of steps required for the piston to draw into the cylinder the desired quantity of that liquid. The tubing segment for that liquid will then close and the output tubing again opened. Returning the piston to the bottom of the cylinder forces that fluid from the cylinder into the receptacle vial. Subsequently, the stepping motor may take the additional step forward and backward to remove the slack, the output tubing closed, and further liquids transferred in this same fashion.

Rather than moving the piston sequentially up and down for each liquid transferred, the pipetter could place several liquids in the cylinder before opening the outlet tubing to expel them. However, this lacks the desirability of the above method which removes each liquid from the cylinder prior to taking in the next. Filling much of the cylinder with sample fluids results in a possibly significant quantity adhering to the cylinder wall near its top. The buffer or neutral liquid may then have difficulty in removing this residual liquid and, thus, result in an inaccurate measurement for the sample under construction and cross-contamination with subsequent solutions. Taking in only a single liquid at a time allows its subsequent cleansing from the cylinder by the buffer.

As suggested by this procedure, the large amount of buffer or any other neutral liquid should follow the other liquids in formulating a desired solution. Doing so cleans the cylinder 17 of any remnants of the active compounds and prepares the outlet tubing for the subsequent sample. Where the desired solution contains no such buffer or neutral liquid, a wash liquid should cleanse the cylinder between solutions. This wash solution may then be discarded.

Proceeding along these lines, the apparatus, when called upon for a microliter of a liquid, has provided about 0.98 to 1.02 microliters at least 90 percent of the time. The error in the measurement has rarely, if ever, exceeded 10 to 15 percent for a one microliter sample.

After preparing the desired solutions, active liquids may remain in their respective tubing segments. At times, these liquids may represent valuable commodities. Accordingly, the pipetter can pump these quantities of liquids back into their original vials. Moreover, a proper program will allow the computer 111 to direct this operation automatically.

An aqueous rinse of the cylinder and tubing segments normally follows the preparation of the needed solutions. This routine may leave water in some or all of these components. Again, the computer can direct the operations incidental to this operation.

The computer 111, with appropriate programming, can also achieve other sophistications in the control of the pipetter. For example, as the motor accelerates, overcoming inertia, it can more quickly respond to input pulses and accomplish its steps of rotation. Accordingly, the computer 111 can induce the oscillator 115 in FIG. 9 to provide quicker pulses to the switch 110 once the motor has begun rotating than at its start. This results in the more expeditious preparation of solutions than were the pipetter limited to the slower speeds achievable by the motor at the start of a rotation.

The computer can also consider the size of a sample pipetted in determining the motor's speed. Small volumes require the slower speeds that produce the greatest accuracy. Larger volumes can proceed at higher speeds while still acheiving the same relative accuracy.

Further, more viscuous liquids impose slower operating speeds upon the motor; elsewise a vacuum may form above the surface of the liquid. If the liquid allows gas bubbles to develop, the volumetric accuracy of the measurements will suffer. Even if no bubbles form, the system must wait until the liquid reaches the piston 18 before closing the inlet tubing. Again, the computer can adjust the operating conditions to the nature of the liquids involved.

The computer can also automatically run the pipetter to dispense one liquid; formulate a solution of several liquids; or even prepare several solutions. Moreover, it can turn the procedure around and take a liquid from one of the vials and place it in several others. Other controller devices, such as those employing microprocessors, can function equivalently to the minicomputer.

FIG. 10 shows an alternate to the syringe shown in the prior figures. This syringe 130 has a cylinder wall 131 and a piston 132. However, instead of the many tubing segments 67 connecting directly to its end as with the syringe 16 in FIGS. 1 and 2, it has the single tube or needle 133. As the needle 133 departs the cylinder 131, it immediately encounters the side channel 134 emanating from it. After the channel 134, the needle 133 has a long uninterrupted section 135 with no other intervening channels. Then, the needle 133 has a number of openings 136 near its end. Although the figure does not show them, the usual tubing segments with their valves may connect with the various openings 134 and 136.

One of the several openings 136 serves as the outlet for the pipetter while the remainder of the openings 136 provide inlets for the liquids which will constitute the prepared solution. The channel 134 acts as the entrance into the syringe for the bufffer or neutral liquid.

Prior to preparing a sample, the buffer should fill the buffer inlet 134, the cylinder 131 up to the piston 132, the straight section 135 of the needle 133, and the outlet opening and tubing to the receptacle vial. The other inlets 136 should contain their own particular liquids. The removal of the last air bubble from the cylinder, however, becomes more difficult with this syringe.

The syringe 130 then measures an amount of a liquid by opening the valving to the appropriate inlet 136 and moving the piston 132 to draw the liquid into the needle 133. However, it should not permit the liquid to move further up the needle 135 than to the channel 134. Limiting the travel to this point facilitates the expulsion of the liquid into the receptacle vial. With the outlet tubing open, the piston 132 returns to its lowermost position. This may, however, leave some of the first liquid in the needle 133.

To entirely remove this liquid from the needle 133, the valving controlling the buffer inlet channel 134 opens and the piston 132 draws buffer into syringe. Closing the channel 134, opening the outlet, and reinserting the plunger 132 then forces buffer through the straight section 135 of the needle 133 and through the outlet. This forces the first measured liquid into the receptacle vial ahead of the buffer. If that liquid had gone beyond the buffer channel 134, perhaps into the cylinder 131, its removal would become significantly more difficult. There it could commingle with the buffer, requiring several subsequent dilutions with additional buffer to effect its removal. Even then, some might remain in the cylinder 131.

The needle 135 may have additional channels at about the same loccation as the illustrated channel 134. This allows for the use of more than one buffer or a buffer and a neutral liquid. At the other end of the needle 135, instead of spacing the two perpendicular openings 136 along the needle, they could enter at a common point. Alternatively, they could have openings opening into the needle around the circumference.

FIG. 11 shows a different syringe which allows easy removal of air during its priming and obviates the long straight section 133 of the needle 135 in FIG. 10. The syringe 140 includes the cylinder 141 and the piston 142. However, the piston 142 has the form of a hollow tube 143 which opens, at its end, into the cylinder 141. At its other end, the tube 143 connects to the control block 144 which allows a mechanical connection to the usual stepper motor. Below the block 144, the tube 143 acts as the rod controlling the movement of the piston 142. Beyond the block 144, the tube 143 connects to a source of buffer or neutral liquid.

Thus, the buffer enters the cylinder 141 by first passing through the tubing segment 145, the control block 144, and the tube 143. The buffer entering the cylinder from the end of the piston 142 departs through the opening 146 at the other end of the cylinder 141. The unidirectional flow through the cylinder 141 facilitates the removal of any air within the cylinder; sufficient buffer may pass through to force the air out the opening 146.

Similarly, the unidirectional flow of buffer also removes any other liquid in the cylinder 141 without the necessity of extensive dilution. As the buffer enters the cylinder 141 it forms a phase barrier with the other liquid and pushes it out through the opening 146.

The liquids for the desired solution enter through the openings 147. They may then pass through the opening 146 and into the barrel 141 of the syringe. Subsequently, the action of the piston and the buffer from the tube 143 forces them out through the end of the cylinder 146 and then through the particular opening 147 connected to the receptacle vial.

Similar to the remarks for FIG. 10, the openings 146 need not occur longitudinally along the needle. They could have a common entry or be spaced radially around the needle circumference.

Accordingly what is claimed is:

1. A pipetter comprising:

A. containing means for holding a fluid to be measured; and

B. Measuring means, in fluid communication with said containing means, for placing one of a plurality of predetermined amounts of fluid into said containing means and moving fluid from within to outside of said containing means, said containing means including at least first and second openings permitting, when said measuring means place fluid into said containing means, the passage of fluid into said containing means without contacting said measuring means, said containing and said measuring means permitting substantially all of the fluid placed in said containing means through said first opening to move outside of said containing means through another opening without substantial dilution by any other fluid.

2. The pipetter of claim 1 wherein said containing means has the shape of a cylinder and said measuring means is a piston disposed inside of said cylinder with a substantially fluid-tight fit.

3. The pipetter of claim 2 wherein said openings are located at one end of said cylinder.

4. The pipetter of claim 3 further including for each of said openings a separate tubing segment connecting with and in fluid communication with that opening.

5. The pipetter of claim 4 wherein a plug comprising one end of each of said tubing segments embedded in a substantially fluid-impermeable material consititutes at least a portion of the end of said cylinder, with said end of said cylinder having no opening except those connecting to said tubine segments.

6. The pipetter of claim 4 including valving means for preventing the passage of fluid through said tubing segments.

7. The pipetter of claim 6 wherein said valving means comprises, for each of said tubing segments, a first member on one side of said tubing segment, a second member on the other side of said tubing segment, and pinching means for moving said first and second members sufficiently close to each other to pinch off the interior of said segment of tubing to prevent the passage of fluid therethrough.

8. The pipetter of claim 7 wherein said tubing segments have a smaller outside diameter in the region near said members than in the area adjoining the region near said members.

9. The pipetter of claim 8 wherein said tubing segment includes first and second sections, said first section lying closer to said cylinder than said second section, the fluid capacity of said first section remaining substantially the same when fluid passes into or out of said containing means as when the amount of fluid in said containing means remains unchanged, and said second section possessing greater flexibility than said first section.

10. The pipetter of claim 9 wherein said tubing segments have a third section connected to and in fluid communication with said second section, said third section being substantially rigid.

11. The pipetter of claim 10 wherein the inside surface of said first section of said tubing segment has a thin coating thereon of a material different than the remainder of said first section.

12. The pipetter of claim 3 wherein in at least 90% of the times when said predetermined quantity is one microliter of liquid, said pipetter delivers an amount of liquid with the range of about 0.98 to 1.02 microliters.

13. The pipetter of claim 3 further including:

A. a stepping motor coupled to said piston;

B. means for converting the rotational motion produced by said stepping motor into relative translational motion between said piston and said cylinder; and C. means for effecting predetermined amounts of rotation by said stepping motor.

14. A pipetter comprising:

A. containing means for holding a fluid to be measured; and

B. measuring means in fluid communication with said containing means for placing one of a plurality of predetermined amounts of fluid into said containing means and moving fluid from within to outside of said containing means, said containing means including first, second, and third opeinings permitting the passage of fluid into said containing means, said containing and said measuring means permitting substantially all of the fluid placed in said containing means through said first opening to move outside of said containing means through another opening without substantial dilution by any other fluid.

15. The pipetter of claim 14 wherein said containing means has the shape of a cylinder and said measuring means is a piston disposed inside of said cylinder with a substantially fluid-tight fit.

16. The pipetter of claim 15 wherein said openings are located at one end of said cylinder.

17. The pipetter of claim 16 further including for each of said openings a separate tubing segment connecting with and in fluid communication with that opening.

18. The pipetter of claim 17 wherein a plug comprising one end of each of said tubing segments embedded in a substantially fluid-impermeable material constitutes at least a portion of the end of said cylinder, with said end of said cylinder having no openings except those connecting to said tubing segments.

19. The pipetter of claim 17 including valving means for preventing the passage of fluid through said tubing segments.

20. The pipetter of claim 19 wherein said valving means comprises for each of said tubing segments a first member on one side of said tubing segment, a second member on the other side of said tubing segment, and pinching means for moving said first and second members sufficiently close to each other to pinch off the interior of said tubing segment to prevent the passage of fluid therethrough.

21. The pipetter of claim 20 wherein said tubing segments have a smaller outside diameter in the region near said members than in the areas adjoining the region near said members.

22. The pipetter of claim 21 wherein said tubing segments include first and second sections, said first section lying closer to said cylinder than said second section, the fluid capacity of said first section remaining substantially the same when fluid passes into or out of said containing means as when the amount of fluid in said containing means remains unchanged, and said second section possessing greater flexibility than said first section.

23. The pipetter of claim 22 further including:

A. a stepping motor coupled to said piston;

B. means for converting the rotational motion produced by said stepping motor into relative translational motion between said piston and said cylinder; and C. means for effecting predetermined amounts of rotation by said stepping motor.

24. The pipetter of claim 23 wherein said first section of said tubing segment is constructed of polyimide; said second section of said tubing segment is made of plasticized polyvinyl chloride; and said tubing segment includes a third section connecting to and in fluid communication with said second section and constructed of a metalic substance.

25. The pipetter of claim 24 wherein said first member is a thin piece of metal, said second member is a thin piece of metal, and said moving means moves said first member in the direction of said second member.

26. The pipetter of claim 25 wherein said third section is made of stainless steel and, on the inside, said first section has a coating of dimethyldichlorosilane.

27. The pipetter of claim 26 wherein a plug comprising one end of each of said first portions of said tubing segments embedded in a substantially fluid-impermeable material constitutes at least a portion of one end of said cylinder, with said one end of said cylinder having no openings except those connecting to said segments of tubing.

28. The pipetter of claim 27 having a least six tubing segments in fluid communication with said cylinder.

29. The pipetter of claim 22 wherein said tubing segments have a third section connected to and in fluid communication with said second section, said third section being substantially rigid.

30. The pipetter of claim 29 wherein the inside surface of said first section of said tubing segment has a thin coating thereon of a material different than the remainder of said first section.

31. The pipetter of claim 16 wherein in at least 90% of the time when said predetermined quantity is one microliter of liquid, said pipetter delivers an amount of liquid within the range of about 0.98 to 1.02 microliters.

32. The pipetter of claim 16 further including:

A. a stepping motor coupled to said piston;

B. means for converting the rotational motion produced by said stepping motor into translational motion between said piston and said cylinder; and C. means for effecting predetermined amounts of rotation by said stepping motor.

33. A pipetter comprising:

A. containing means for holding a fluid to be measured, said containing means having at least one opening permitting the passage of fluid into said containing means;

B. measuring means in fluid communication with said containing means for placing fluid into said containing means;

C. a tubing segment connected to and in fluid communication with said opening in said containing means such that fluid passing through said opening passes through said tubing segment, said tubing segment including first and second sections with said first section being closer to said containing means than said second section, the fluid capacity of said first section remaining substantially the same when fluid passes into or out of said containing means as when the amount of fluid in said containing means remains unchanged, said second section of said tubing segment being different than said first section; and D. valving means disposed on the outside of said second section of said tubing segment, for applying a pinching force to said second section, said second section of said tubing segment possessing sufficient flexibility of said valving means applying a sufficient pinching force that when said valving means applies said force, said second section of said tubing segment constricts and substantially prevents the passage of fluid therethrough.

34. The pipetter of claim 33 wherein said containing means has the shape of a cylinder and said measuring means is a piston disposed inside of said cylinder with a substantially fluid-tight fit.

35. The pipetter of claim 34 wherein said opening is located at one end of said cylinder.

36. The pipetter of claim 35 wherein (1) said opening in said containing means is a first opening and said containing means has second and third openings permitting the passage of fluid into said containing means; (2) said tubing segment is a first tubing segment and said pipetter includes second and third tubing segments connected to and in fluid communication with said second and third openings respectively, said second and third tubing segments having first and second sections substantially the same as said first tubing segment; and (3) a plug comprising one end of each of said tubing segments embedded in a substantially fluid-impermeable material constitutes at least a portion of one end of said cylinder, with said one end of said cylinder having no openings except those connecting to said tubing segments.

37. The pipetter of claim 36 wherein said valving means comprises, for each of said tubing segments a first member on one side of said second section of said tubing segment, a second member on the other side of said second section of said tubing segment, and pinching means for moving said first and second members sufficiently close to each other to pinch off the interior of said second section of said tubing segment.

38. The pipetter of claim 37 wherein said second section of said tubing segment has a smaller outside diameter in the region near said members than the areas adjoining the region near said members.

39. The pipetter of claim 35 further including:

A. a stepping motor coupled to said piston;

B. means for converting the rotational motion produced by said stepping motor into relative translational motion between said piston and said cylinder; and C. means for effecting predetermined amounts of rotation by said stepping motor.

40. A method of pipetting which comprises:

A. placing a particular fluid through a first passageway into a containing means;

B. closing said first passageway to the passage of fluid;

C. opening a second passageway into said containing means; and

D. moving substantially all of said particular fluid in said containing means out through said second passageway without substantial dilution by any other fluid;

E. opening a third passageway into said containing means; and

F. moving a fluid through said third passageway.

41. The method of claim 40 wherein, when said containing means is a cylinder having a piston therein, the placing of a fluid through a passageway into said cylinder is accomplished by partially withdrawing said piston from said cylinder.

42. The claim of 41 wherein fluid is placed through said third passageway into said cylinder and further including the steps of closing said third passageway; opening said second passageway; and moving at least a portion of the fluid placed into said cylinder through said third passageway out through said second passageway.

43. The method of claim 42 wherein, when the fluid placed into said cylinder through said first and said third passageways is moved out through said second passageway into a common receptacle, of the last fluid moved into said common receptacle from said cylinder a larger quantity is moved into said common receptacle than the quantity of any other fluid moved in said receptacle from said cylinder.

44. The method of claim 43 wherein, after fluid is moved out from said cylinder into said common receptacle and prior to placing in said cylinder any fluid other than said last fluid moved into said common receptacle, said piston is partially withdrawn from said cylinder with none of the passageways, through which any fluid other than said last fluid passes into said cylinder, being open.

45. The method of claim 44 wherein said second passageway is open when said piston is partially withdrawn from said cylinder after moving fluid into said common receptacle and before placing fluid into said cylinder.

46. The method of claim 43 wherein the closing of a passageway is accomplished by applying sufficient pressure to the outside of a flexible tubing segment forming part of said passageway to close said segment of tubing to the passage of fluid.

47. The method of claim 44 wherein the closing of a passageway is accomplished by applying sufficient pressure to the outside of a flexible tubing segment forming part of said passageway to close said segment of tubing to the passage of fluid.

48. The method of claim 47 wherein the step of partially withdrawing said piston from said cylinder is accomplished by actuating a stepping motor to rotate a predetermined number of steps and converting that rotation to a relative translational motion between said piston and said cylinder.

49. The method of claim 43 wherein the step of partially withdrawing said piston from said cylinder is accomplished by actuating a stepping motor to rotate a predetermined number of steps and converting that rotation to a relative translational motion between said piston and said cylinder.

50. The method of claim 49 wherein, after moving fluid out from said cylinder and prior to placing fluid into said cylinder, and with said second passageway open, said stepping motor is actuated to rotate at least one step in the direction that will withdraw said piston from said cylinder.

* * * * *